US006612089B1

(12) United States Patent
Mann

(10) Patent No.: US 6,612,089 B1
(45) Date of Patent: Sep. 2, 2003

(54) POWER INSIDE CORNER PLANER AND METHOD OF USE

(76) Inventor: Christopher L. Mann, 36135 Arnett Rd., Wildomar, CA (US) 92595

( * ) Notice: Subject to any disclaimer, the term of this patent is extended or adjusted under 35 U.S.C. 154(b) by 40 days.

(21) Appl. No.: 10/026,229

(22) Filed: Dec. 21, 2001

(51) Int. Cl.[7] ..... E04F 21/00
(52) U.S. Cl. ..... 52/749.1; 144/117.4
(58) Field of Search ..... 52/DIG. 1, 749.1; 144/114.1, 117.1, 117.2, 117.3, 117.4, 131

(56) References Cited

U.S. PATENT DOCUMENTS 4,693,648 A * 9/1987 Cavedo ..... 409/178
5,383,275 A * 1/1995 Hild et al. ..... 30/475

* cited by examiner

*Primary Examiner*—Carl D. Friedman
*Assistant Examiner*—Naoko Slack
(74) *Attorney, Agent, or Firm*—Timothy Thut Tyson; Ted Masters; Freilich, Hornbaker & Rosen

(57) ABSTRACT

An electric inside corner planer (20) with a cylindrical cutter assembly (30) has a housing (21) and front shoe (22) constructed with a side angled along a line (46) determined by the front outside of the cutter (30) and the front outside of the bearing (41) holding the cutter. The angled side of the planer puts the cutter assembly as close as possible to the interfering structure in the corner. Right angled (20), left angled (70), and combined right and left angled (120) planer embodiments are shown.

10 Claims, 12 Drawing Sheets

A
32
46
20
22
44
30
40
42
45
48
47
43
R
41
34,38
46
21
L
26

$D_1 = R \sin A$

POWER INSIDE CORNER PLANER AND METHOD OF USE

TECHNICAL FIELD

The present invention pertains generally to electric power planers, and more particularly to an inside corner power planer which permits the user to plane areas close to interfering structures such as an adjacent perpendicular wall.

BACKGROUND ART

As a part of the construction of a wood frame house, one stage is the erection of stud walls and other wood framing. The carpenters try to make the planes of the walls flat as they go but sometimes they make a mistake and insert bent studs or studs warp later due to moisture. Prior to installing sheet rock panels on a wall, a crew uses a level to make sure the outer surfaces of the studs in the wall are all in the same plane. Any studs that are out of the plane of the wall are planed off with an electric planer if they are too high or built up using thin wood strips if they are too low until the wall is perfectly flat. A conventional electric power planer can be used for most of the work including the leveling of outside corners. However, a conventional electric power planer is not very useful on an inside corner. The housing of the planer butts against the adjacent wall keeping the planer blade away from the corner leaving an unplaned strip. Since the wall must be perfectly flat all the way into the corners in order to properly install the sheet rock panels, the unplaned strip left in the inside corners must be removed by hand with a hammer and chisel until the entire wall is flat.

FIGS. 1–4 illustrate bottom plan, top plan, left side elevation, and reduced top plan views, respectively, of a conventional prior art electric power planer, generally designated 500. Conventional planer 500 has a front shoe 502 with a flat lower surface 504 and a rear shoe 506 with a flat lower surface 508. A cylindrical rotatable cutter assembly 510 is positioned between front shoe 502 and rear shoe 506. The longitudinal axis 512 of the planer passes through front shoe 502, rear shoe 506, and cutter assembly 510. Cylindrical cutter assembly 510 rotates on an axis of rotation 514 perpendicular to longitudinal axis 512 on bearings on either end which are not shown. Cylindrical cutter assembly 510 has removable blades 516 which perform the planing operation when cutter assembly 510 is rapidly rotated by a motor 523 powering a belt 525.

As shown on FIGS. 2 and 3, when cutter assembly 510 is rotated, it has a cylindrical cutting envelope shown in dotted outline with a length L and a radius R. Anything inside the cutting envelope would be cut by the whirling blades 516. The forward most projecting line 520 of the envelope is parallel to axis 514. The right end 522 of the envelope is perpendicular to axis 514. The plane 500 is designed to cut material along a cutting line 518 parallel to axis 514 and slightly below the plane of flat lower surfaces 504 and 508 of front and rear shoes 502 and 506. When planer 500 is used to plane a surface 600 of a workpiece such as a stud in FIG. 4, the planing operation can be performed satisfactorily until the plane bumps into an interfering structure 602 such as an adjacent perpendicular wall. Then cutter assembly 510 cannot reach the surface 600 adjacent interfering structure 602 because the housing 501 for the motor 523 gets in the way. As planer 500 planes up in direction 524, it leaves an unplaned swath of width D. Depending upon the construction of the particular planer, distanced is typically 1.25 inches.

Woodworking tools have been developed for removing material into corners. For example, U.S. Pat. No. 2,432,753 shows a shaping tool with two handgrips powered through a flexible shaft by a remote electric motor. While the cutter shown is for an outside corner, a cutter for an inside corner might also be developed.

U.S. Pat. No. 4,711,799 illustrates a router having a bit shaped to make a concave surface in an inside corner. The bit could be modified to make a 90° angle. The router is mounted in a holder having 90° sides which positions the bit as needed in the corner.

U.S. Pat. No. 4,993,897 discloses another router and holder for working on inside corners.

An electric power planer has much larger blade surfaces for removing wood than is possible in a router bit. Faster material removal and longer blade life are therefore possible with a planer than with a router. A planer which could remove material in the inside corner of a structure would offer an advantage over the prior art.

DISCLOSURE OF INVENTION

The present invention is directed to an electric power planer which can plane into inside corners close to interfering structures such as walls. The planer can also be used to plane around fixtures such as electrical outlets, heating and air conditioning registers, and lighting fixtures. The planer is specifically designed to place the outer edge of the cylindrical cutter assembly adjacent the interfering structure. This is accomplished by constructing the housing of the planer at an angle to the cutter assembly so that the end of the forward most projecting line of the cutter assembly is proximate to the edge of the housing.

In accordance with a preferred embodiment of the invention, the planer has a bearing at the outer end of the cylindrical cutter. The housing on the planer has an edge that is substantially defined by a line from the front outermost point of the bearing to the end of the forward most projecting line of the envelope defined by the rotating cylindrical cutter assembly.

In accordance with an important aspect of the invention, the planer has a front shoe having an edge also defined by the line from the front outermost point of the bearing to the end of the forward most projecting line of the cylindrical cutter envelope.

In accordance with a preferred embodiment, the housing is constructed to be angled with respect to the cutter assembly on the right side of the plane.

In accordance with another preferred embodiment, the housing is constructed to be angled with respect to the cutter assembly on the left side of the plane.

In accordance with yet another preferred embodiment, the housing is constructed to be angled with respect to the cutter assembly on both the right and left sides of the plane.

In accordance with another preferred embodiment of the invention, a method of planing a workpiece adjacent an interfering structure is provide, including:

- providing an electric power planer having a housing, a cylindrical cutter having a cutter envelope, and a bearing, the housing having an edge substantially defined by a line from the end of the forward most projecting line of the cylindrical cutter envelope to the front outermost point of the bearing;
- providing a workpiece adjacent an interfering structure; and,
- planing the workpiece while touching the interfering structure with the edge of the housing.

In accordance with an important aspect of the invention, the step of providing an electric power planer further includes providing a front shoe with an edge defined by the line from the front outermost point of the bearing to the end of the forward most projecting line of the cylindrical cutter envelope, and the step of planing the workpiece while touching the interfering structure includes touching both the edge of the housing and the edge of the shoe against the interfering structure.

In accordance with an important aspect of the invention, prior to the planing step, providing wedges and using the wedges to move the workpiece away from the interfering structure.

In accordance with yet another important aspect of the invention, after the planing step, further including the step of removing the wedges.

Other features and advantages of the present invention will become apparent from the following detailed description, taken in conjunction with the accompanying drawings, which illustrate, by way of example, the principles of the invention.

MODES FOR CARRYING OUT THE INVENTION

Figure 5:
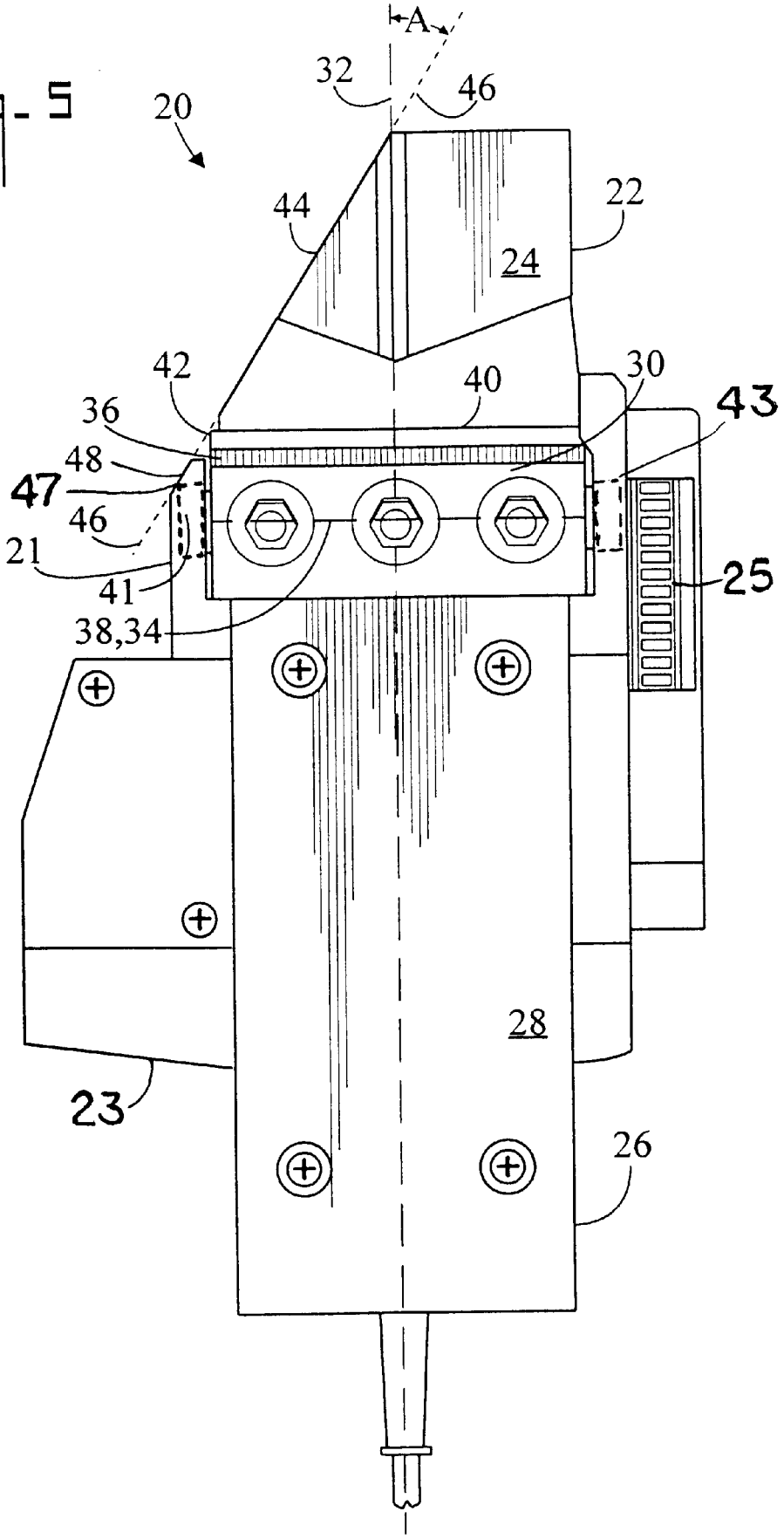
FIG. 5 is a bottom plan view of a planer in accordance with the present invention.
Figure 6:
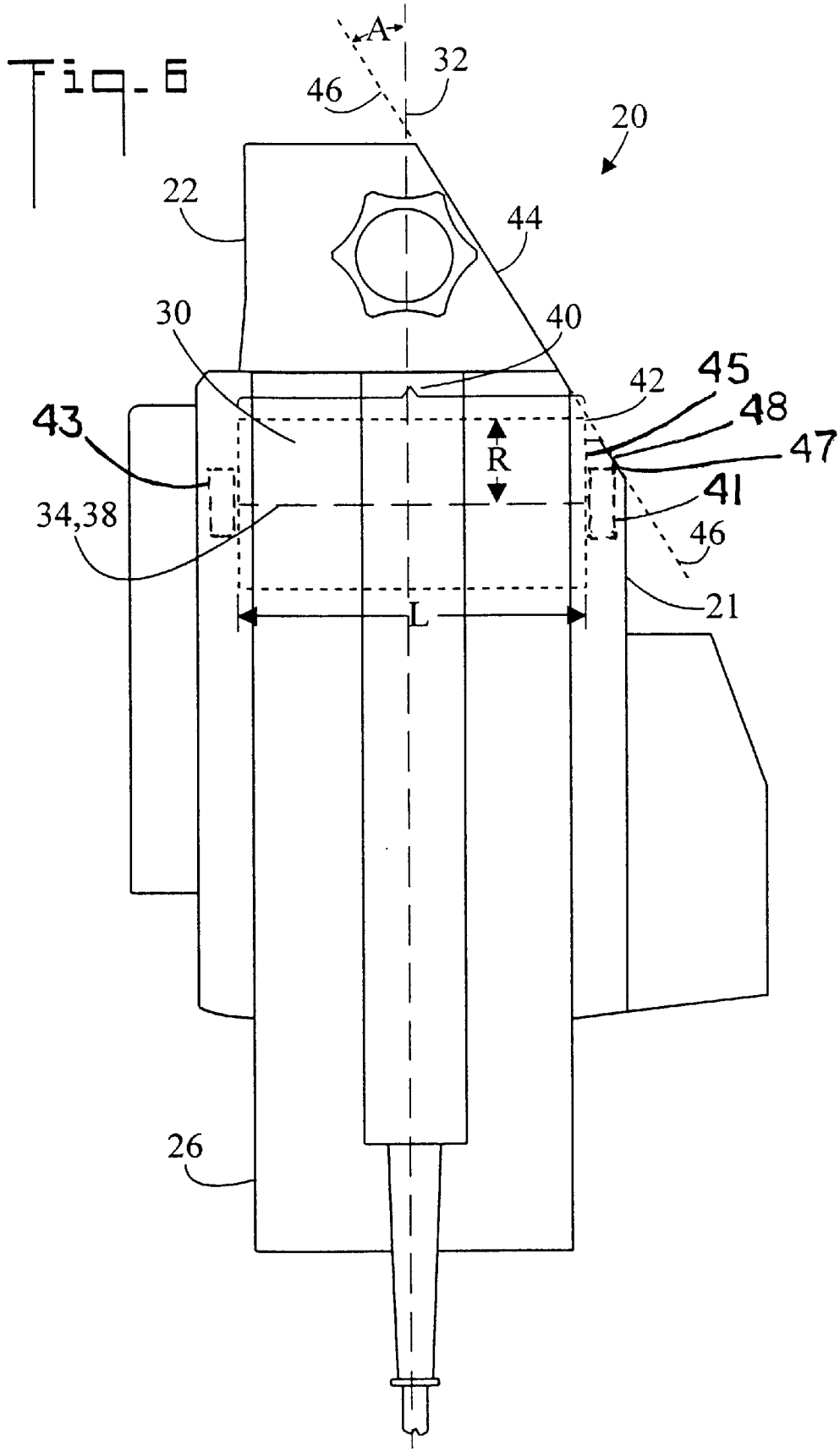
FIG. 6 is a top plan view of the planer of FIG. 5.
Figure 7:
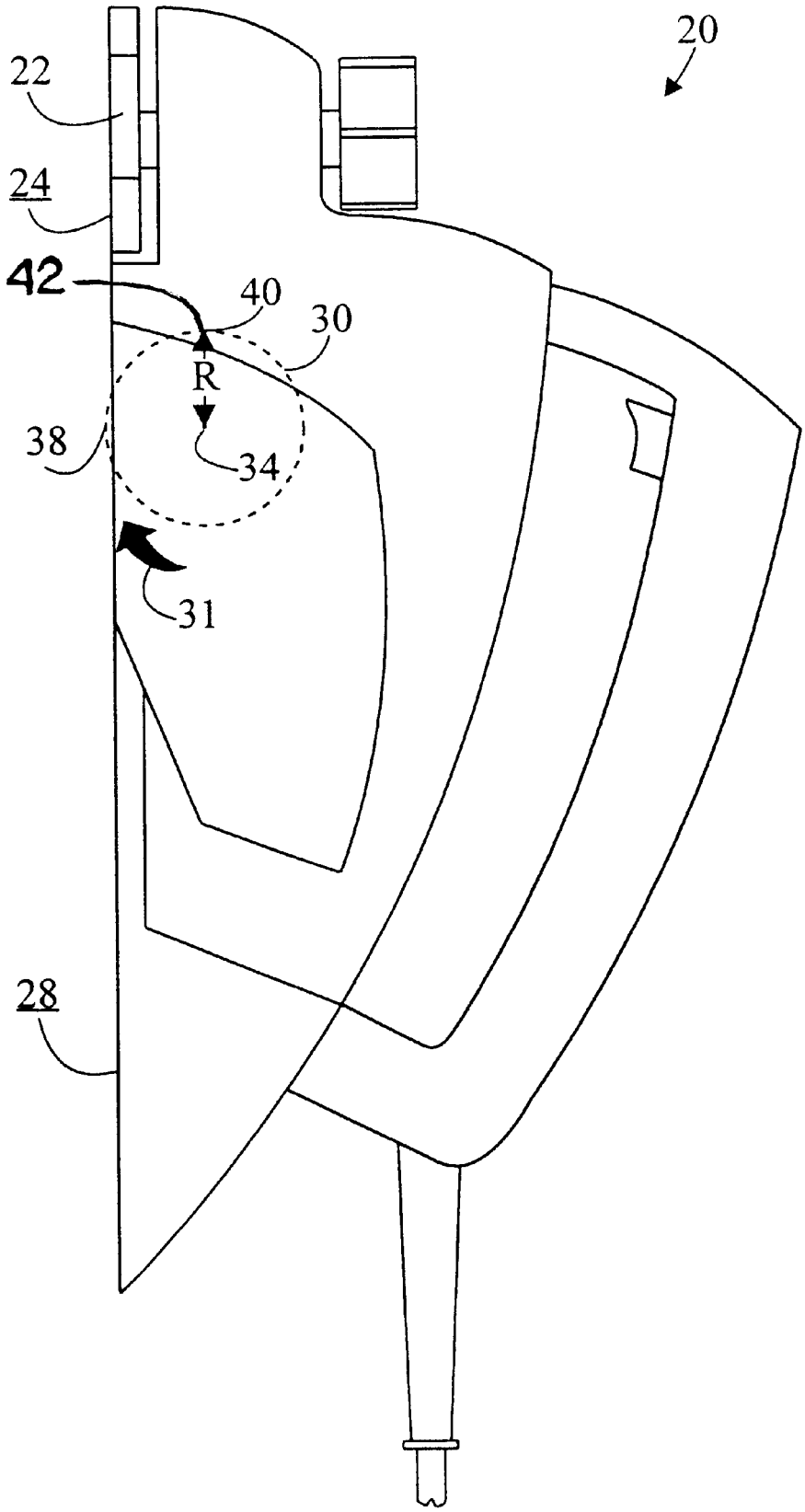
FIG. 7 is a left side elevation view of the planer of FIG. 5.

FIGS. 5–7 illustrate bottom plan, top plan, and left side elevation views, respectively, of a planer in accordance with the present invention, generally designated as 20. Planer 20 has a front shoe 22 with a flat lower surface 24 and a rear shoe 26 with a flat lower surface 28. A cylindrical rotatable cutter assembly 30 is positioned between front shoe 22 and rear shoe 26. The longitudinal axis 32 of the planer passes through front shoe 22, rear shoe 26, and cutter assembly 30. Cutter assembly 30 has an axis of rotation 34 which is perpendicular to longitudinal axis 32. Bearings 41 and 43, indicated by the dotted outlines, hold cutter assembly 30. Cutter assembly 30 has blades 36 which perform the planing operation when cutter assembly 30 is rapidly rotated in direction 31 (FIG. 7) by a drive belt 25 powered by a motor 23.

As shown on FIG. 6 and 7, when cutter assembly 30 is rotated, it has a cylindrical cutting envelope shown in dotted outline with a length L and a radius R. Anything inside the cutting envelope would be cut by the whirling blades 36. The forward most projecting line 40 of the envelope is parallel to axis of rotation 34. The right end 45 of the envelope is perpendicular to axis of rotation 34. The plane 20 is designed to cut material along a cutting line 38 parallel to axis of rotation 34 and slightly below the plane of flat lower surfaces 24 and 28 of front and rear shoes 22 and 26.

In order to plane as close as possible to an adjacent vertical interfering structure 602 (see FIG. 8), the right end 39 (FIG. 9) of the cutting line 38 at the right end 45 of the cutting envelope should be brought adjacent the structure. This is done by constructing the right side of the housing 21 at an angle with respect to the cutting line 38 placing the right end of the blade 36 as close as possible to the outside of the planer. The angle is determined by a point 42 where the forward most projecting line 40 of the envelope intersects the right end 45 of the envelope and a point 47 at the outermost front of the right bearing 41. Moving inside the point 42 would allow the whirling blades 36 to touch the vertical interfering structure and blemish it which would not be desirable. Moving inside the point 47 of the bearing 41 is not possible. So an angular line 46 results between the points 42 and 47 which determines the side of the housing 21 of the planer. This line 46 is at an angle A with respect to the longitudinal axis 32 of the plane and the right end 45 of the cutting envelope. Housing 21 has a first edge 48 which is substantially defined by the angled line 46. Front shoe 22 has a second edge 44 which is also defined by line 46. When the planer 20 is used, edges 44 and 48 are pushed up against the interfering structure 602.

One added advantage of the inside corner planer besides being able to plane into the corner in the first place is that it throws the wood chips created during the planing process away from the comer because the planing operation takes place at an angle directed away from the corner. The chips and dust from a conventional planer tend to accumulate in the corner. The inside comer planer can also be used as a conventional planer in a straight line along the axis 32 when no interfering side structures are present. The carpenter therefore needs only one planer to level an entire wall.

Figure 8:
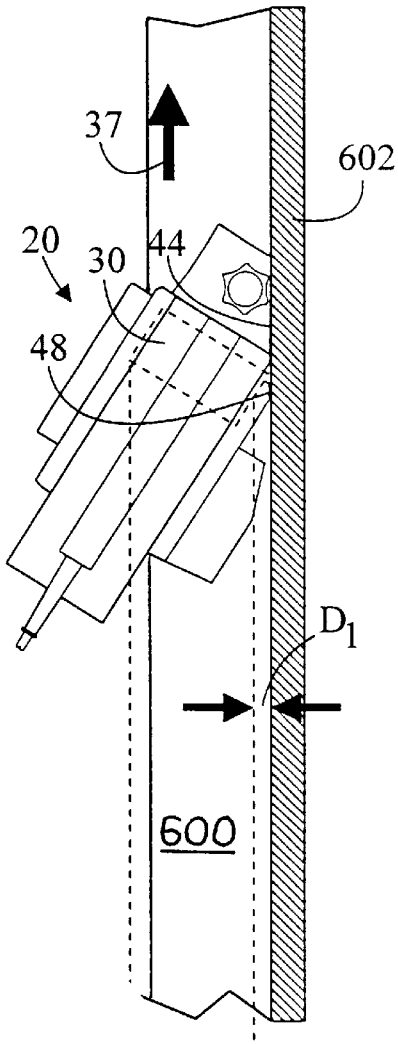
FIG. 8 is a reduced top plan view of the planer of FIG. 5 planing a surface adjacent an interfering structure.

FIG. 8 is a reduced top plan view of planer 20 of the present invention planing a surface 600 such as a stud adjacent an interfering structure 602 such as a perpendicular wall. Front shoe 22 and rear shoe 26 of planer 20 have been placed on surface 600, with shoe second edge 44 and housing first edge 48 placed flush against interfering structure 602. As planer 20 is moved upward in direction 37, an unplaned swath having a width $D_1$ is created.

Figure 1:
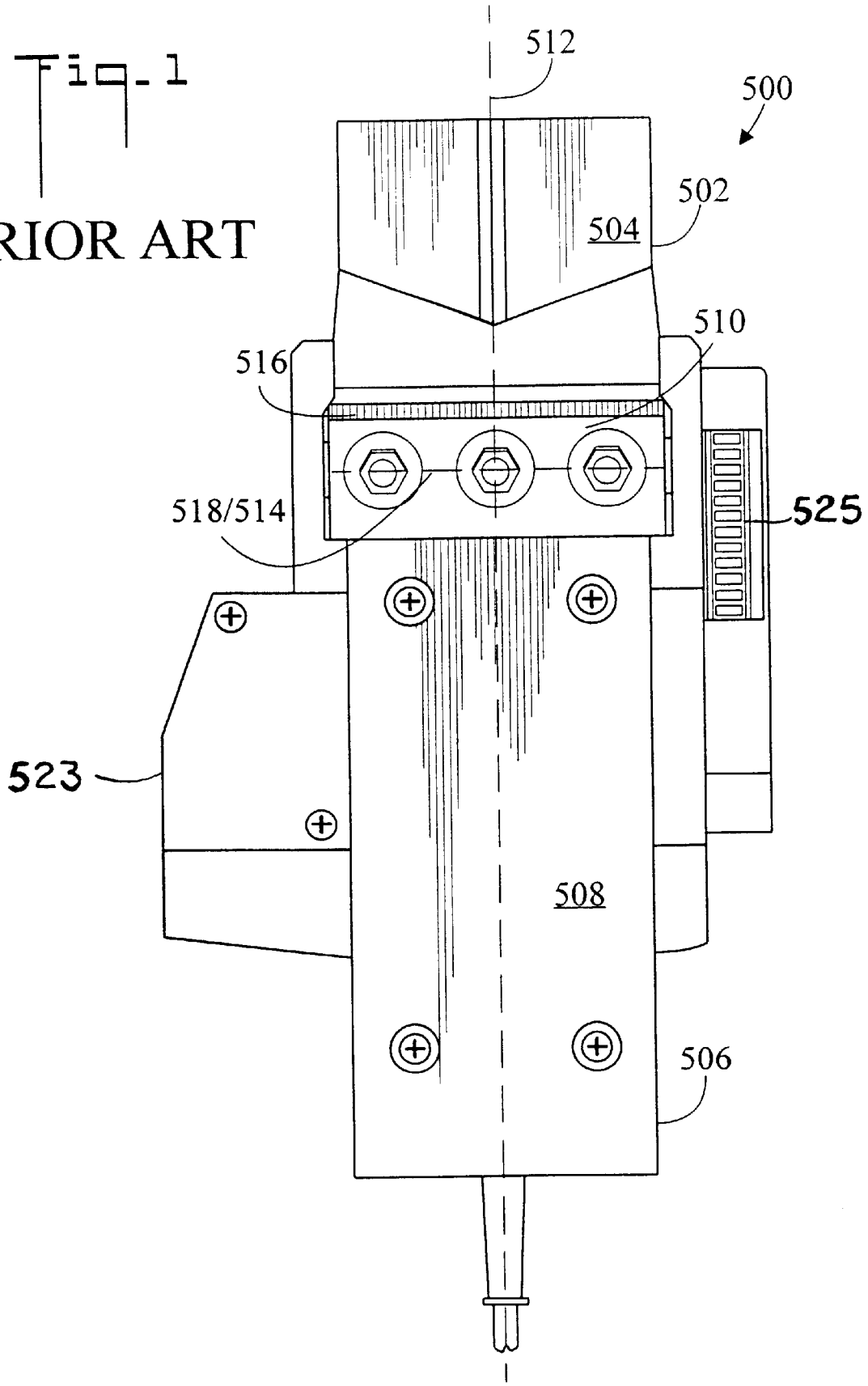
Fig. 1 PRIOR ART
FIG. 1 is a bottom plan view of a conventional prior art planer.
Figure 2:
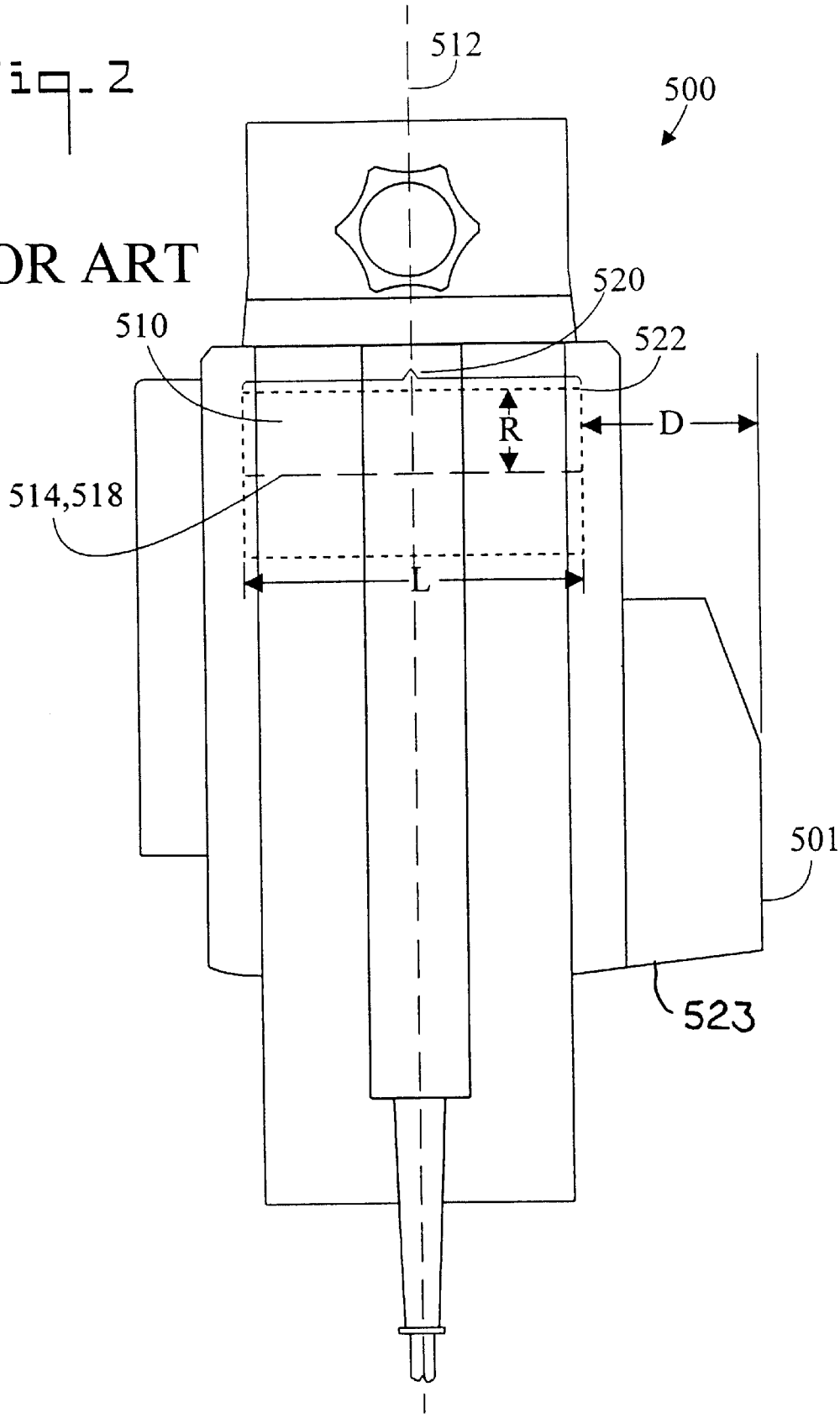
Fig. 2 PRIOR ART
FIG. 2 is a top plan view of the prior art planer.
Figure 3:
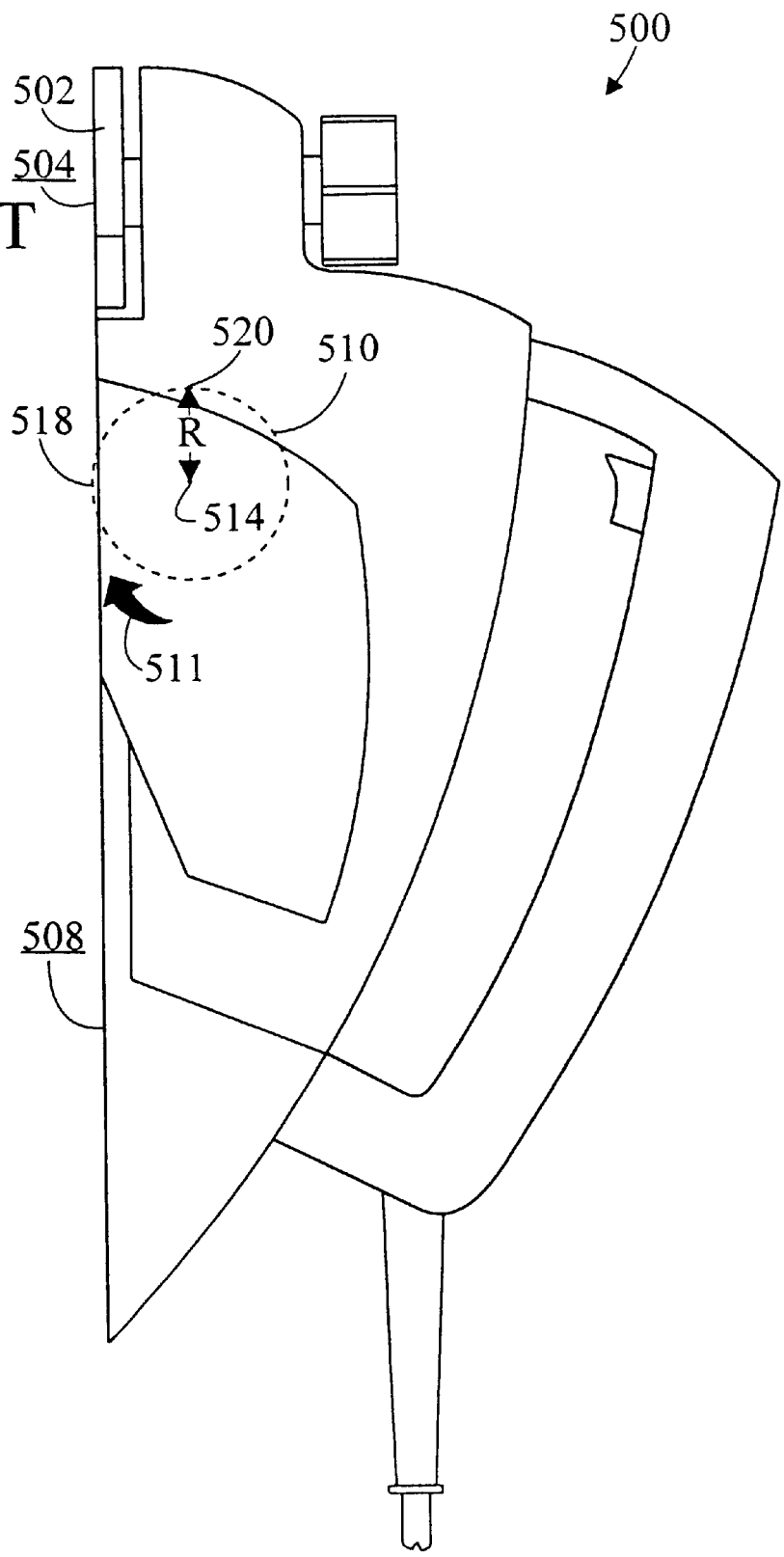
Fig. 3 PRIOR ART
FIG. 3 is a left side elevation view of the prior art planer.
Figure 4:
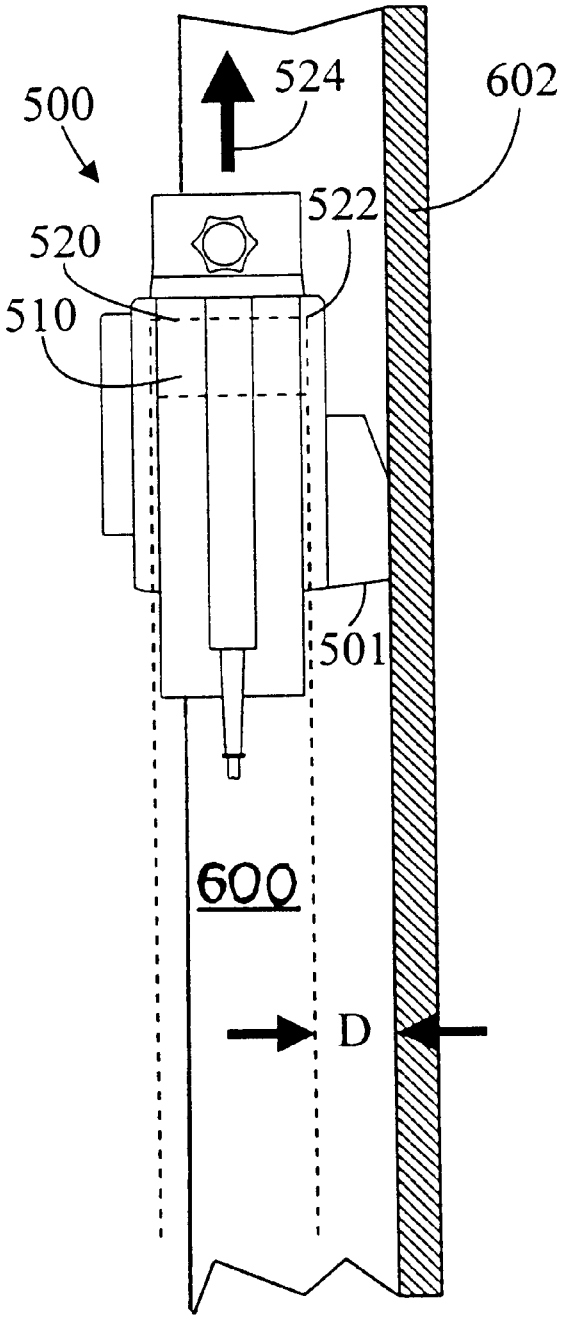
Fig. 4 PRIOR ART
FIG. 4 is a reduced top plan view of the prior art planer planing a workpiece adjacent an interfering structure.
Figure 9:
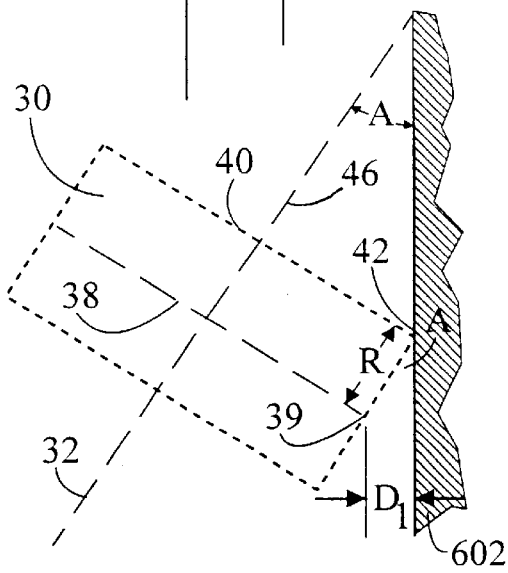
FIG. 9 is an enlarged diagram showing the relationship between the cutter assembly of the planer and the interfering structure.

FIG. 9 is an enlarged diagram showing the relationship between cutter assembly 30 of planer 30 and interfering structure 602 as depicted in FIG. 8. End 39 of cutting line 38 is a distance $D_1$ from interfering structure 602, wherein $D_1$ is substantially equal to (R sin A). Typically R equals 0.75 inches and A equals 30°. The distance is therefore about 0.375 inches. When edge 44 and 48 are moved along interfering structure 602, an unplaned swath having width $D_1$, e.g. 0.375 inches, is left on surface 600. This is significantly less than the swath D (FIG. 4) left by the conventional planer which is substantially 1.25 inches wide. A swath 0.375 inches wide often may be easily split off the stud by hitting sideways with a hammer or a hammer and chisel. On the other hand, removal of a swath 1.25 inches width is a difficult task requiring repeated use of a hammer and chisel.

Figure 10:
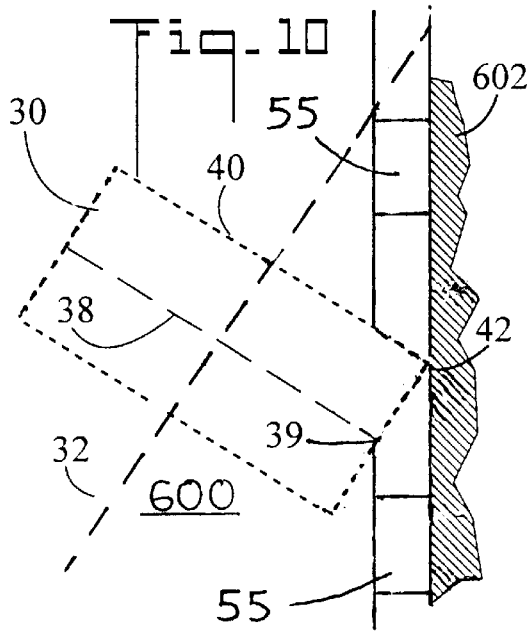
FIG. 10 is an enlarged diagram similar to FIG. 9 showing the workpiece moved away from the interfering structure using wedges.

FIG. 10 is an enlarged diagram similar to FIG. 9 showing the use of wooden wedges 55 to push the stud 600 or other workpiece away from the wall 602 or other interfering structure. If the stud is pushed away from the wall 0.375 inches by the wedges, the inside corner planer 20 is able to plane the entire width of the surface 600 without leaving an unplaned swath at all. The wedges 55 do not interfere with the planing operation because they are also made of wood and are simply planed away if they are in the way. After the surface 600 has been planed to the desire level, the carpenter can quickly pull the wedges out using a hook or screwdriver.

Figure 11:
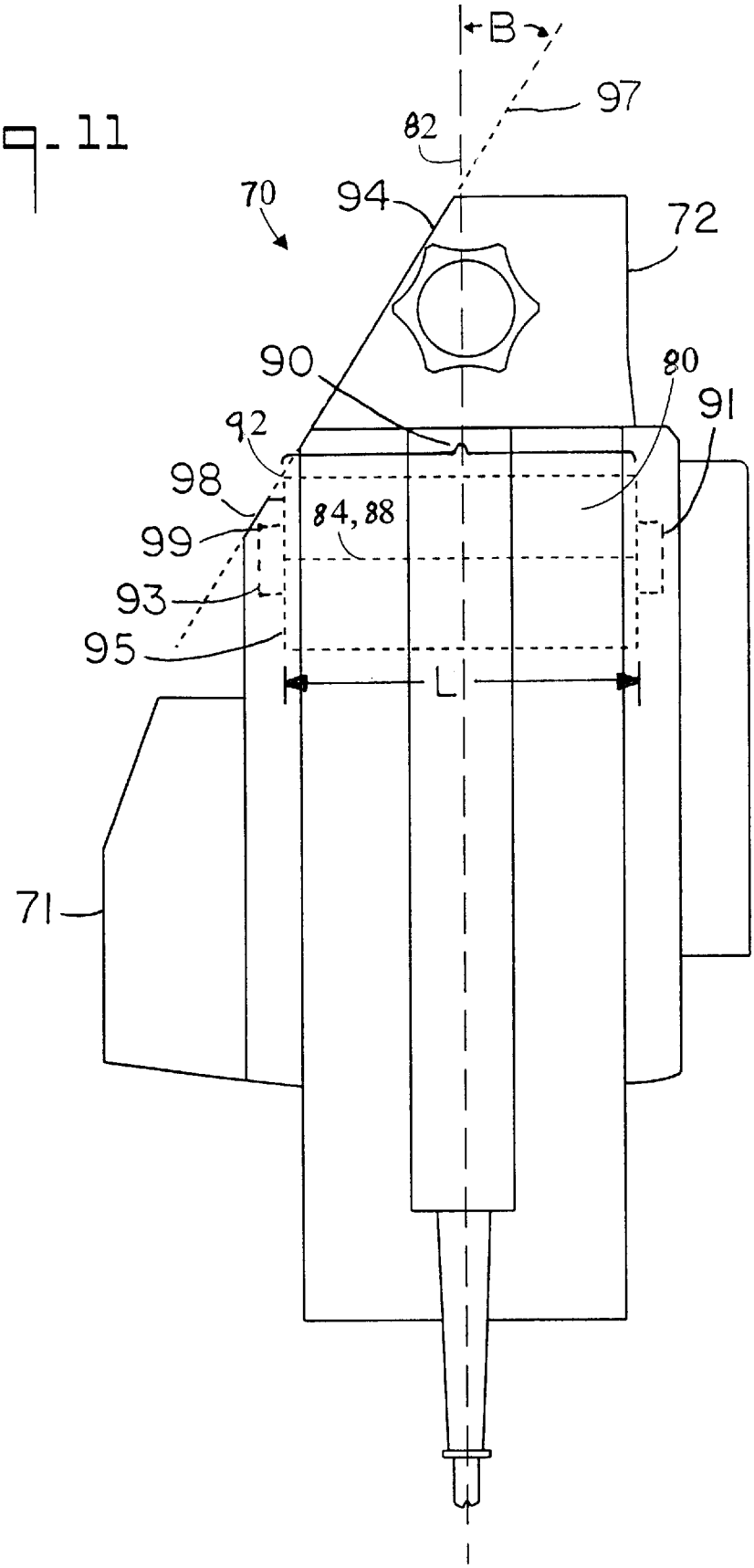
FIG. 11 is a top plan view of a second embodiment of the planer which is the mirror image on of the planer of FIG. 6.

FIG. 11 is a top plan view of a second embodiment of the planer, generally designated 70, which is a mirror image of the first embodiment of the planer of FIG. 6. A cylindrical rotatable cutter assembly 80 is positioned between a front shoe 72 and a rear shoe. The longitudinal axis 82 of the planer passes through front shoe 72, the rear shoe, and cutter assembly 80. Cutter assembly 80 has an axis of rotation 84 which is perpendicular to longitudinal axis 82. Bearings 91 and 93, indicated by the dotted outlines, hold cutter assembly 80. When cutter assembly 80 is rotated, it has a cylindrical cutting envelope shown in dotted outline with a length L and a radius R. Anything inside the cutting envelope would be cut. The forward most projecting line 90 of the envelope is parallel to axis of rotation 84. The left end 95 of the envelope is perpendicular to axis of rotation 84. The plane 70 is designed to cut material along a cutting line 88 parallel to axis of rotation 84 and slightly below the plane of the flat lower surfaces of the plane. The left side of the housing 71 is constructed at an angle with respect to the cutting line. 88 placing the left end of the cutting blade as close as possible to the outside of the planer. The angle is determined by a point 92 where the forward most projecting line 90 of the envelope intersects the right end 95 of the envelope and a point 99 at the outermost front of the left bearing 93. So an angular line 97 results between the points 92 and 99 which determines the left side of the housing 71 of the planer. This line 97 is at an angle B with respect to the longitudinal axis 82 of the plane and the left end 95 of the cutting envelope. Front shoe 72 of planer 70 has a fourth edge 94 which is defined by the angled line 96. A third edge 98 along housing 71 is also defined by line 97. When the planer 70 is used, edges 94 and 98 are pushed up against the interfering structure. All other elements of the second embodiment are mirror images of the same elements in the first embodiment.

FIGS. 6 and 11 show that a power inside corner planer can be constructed with an angled side on either the right or left. Because of the throw of the chips away from the planer, it is generally more desirable to have the chips thrown down away from the operator instead of up where they can ricochet around and the smaller particles can float around. This means that the preferred method for using an inside corner planer is to push it up in the corner. Since half of the sides of corners to be planed are on the right side and half of the sides are on the left side, inside comer planers of both the first and second embodiment would be useful to a carpenter.

Figure 12:
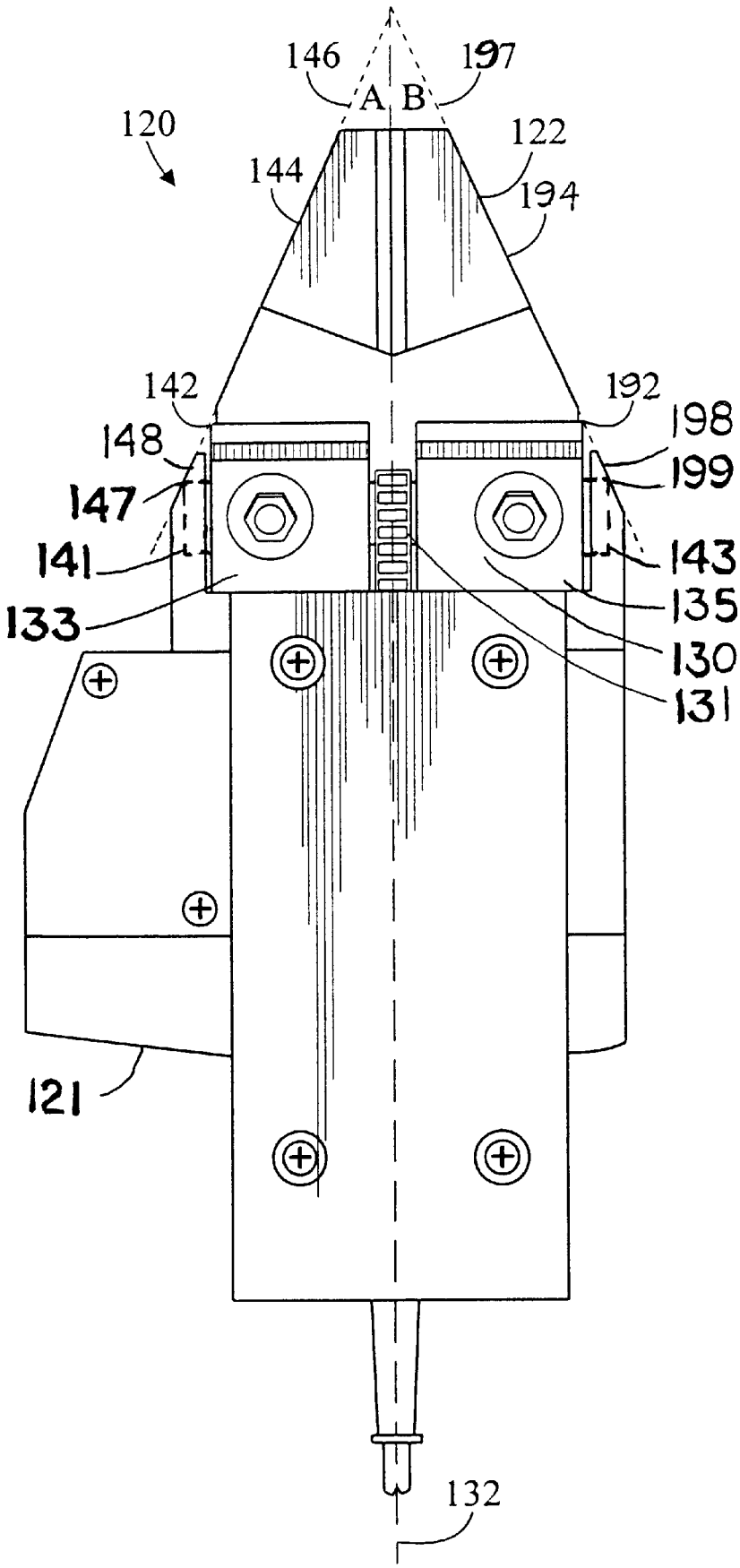
FIG. 12 is a bottom plan view of a third embodiment of the planer.
Figure 13:
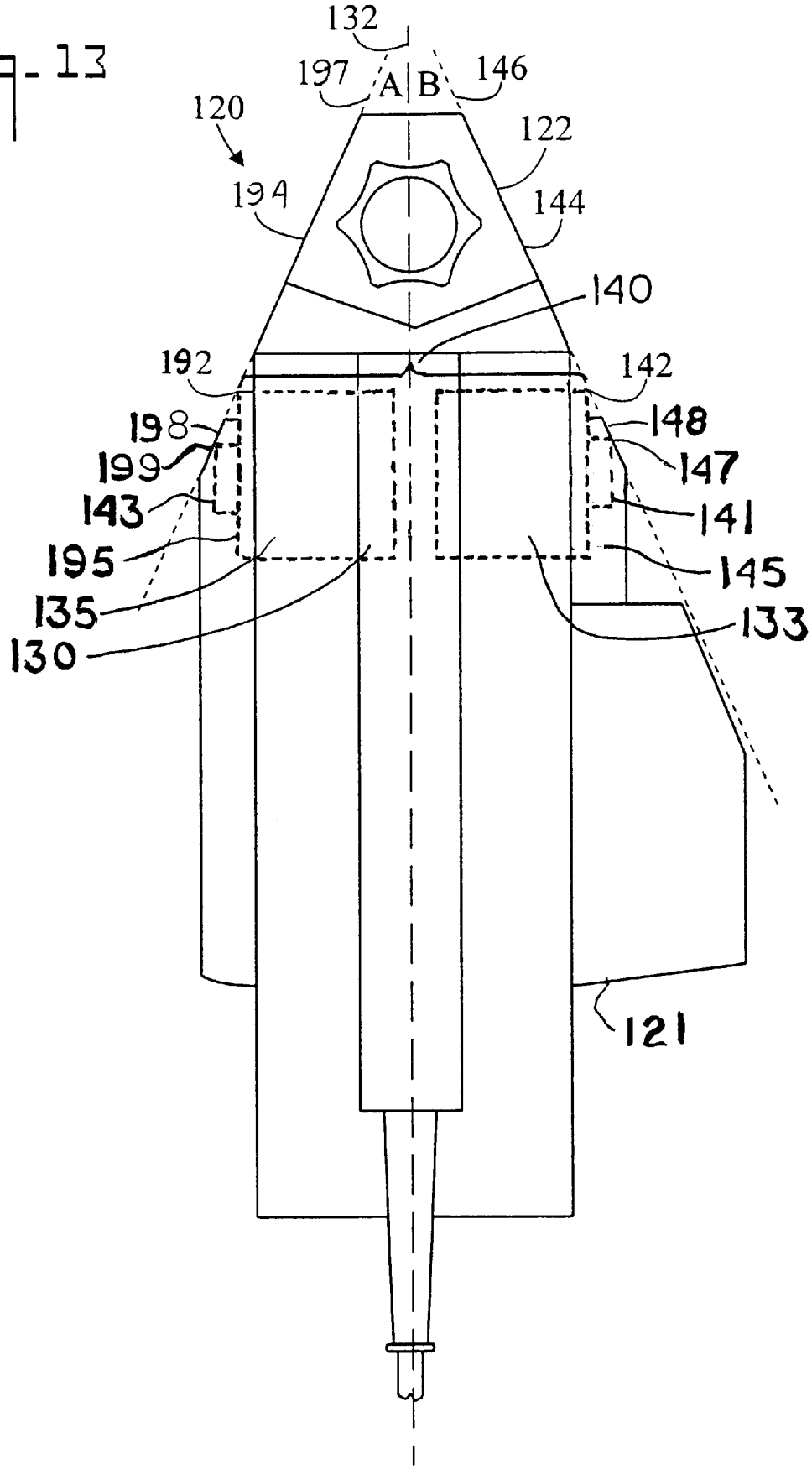
FIG. 13 is a top plan view of the planer of FIG. 12.

FIGS. 12 and 13 are bottom plan and top plan views, respectively, of a third embodiment of the planer of the present invention, generally designated as 120. The third embodiment combines the features of both the first and second embodiments of FIGS. 6 and 11. It has angled sides on both sides so that it may be pushed up in an inner comer whether the left or right side needs to be planed merely by selecting the side of the planer to use. Longitudinal axis 132 is centrally disposed along planer 120. Right angled line 146 is defined in the same manner as in the first embodiment above being determined by the right end 142 of the forward most projecting line 140 where it intersects the right end 145 of the cutter envelope and the front outermost point 147 of the right bearing 141. Left angled line 197 is defined as in the second embodiment above and is determined by the left end 192 of the line 140 where it intersects the left end 195 of the cutter envelope and the front outermost point 199 of the left bearing 143. Front shoe 122 is constructed to have a first right edge 144 determined by the right angled line 146 and a fourth left edge 194 determined by the left angled line 197. Second right edge 148 on the right side of the housing 121 of the planer is also determined by right angled line 146. Third left edge 198 on the left side of the housing 121 is also determined by left angled line 197. Right angled line 146 makes a first acute angle A with longitudinal axis 132. Left angled line 197 makes a second acute angle B with longitudinal axis 132 which is on the opposite side of longitudinal axis 132 from acute angle A.

In the third embodiment, cutter assembly 130 is separated into two cutters, right cutter 133 and left cutter 135, by a central drive belt 131. The requirement for a central drive belt 131 will leave a small unplaned area in the middle. This unplaned area is somewhat minimized by the fact that the cutter 130 operates at an angle so that the unplaned width is always less than the width of the belt. Also, cutter assembly 130 can be constructed so that each of its left and right cutters 133 and 135 are wide enough to independently complete a corner planing job by itself.

Figure 14:
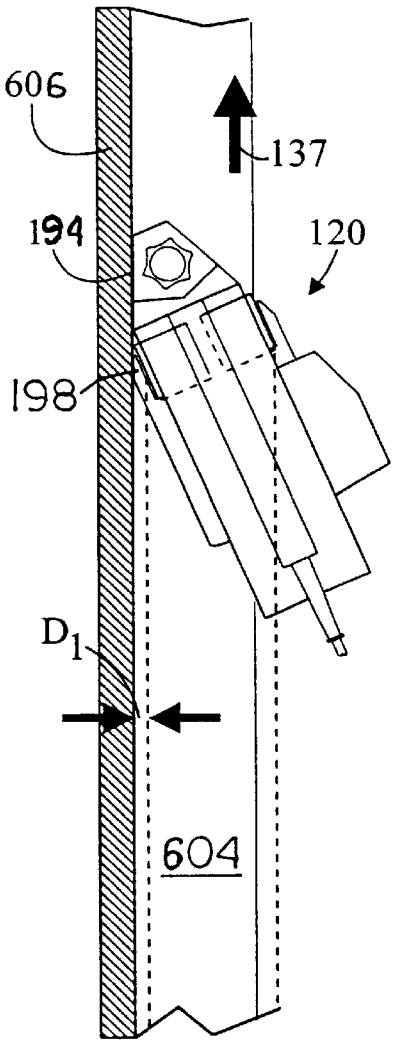
FIG. 14 is a reduced top plan view of the planer of FIG. 12 planing a surface having an inter structure on the left side; and, FIG. 15 is a reduced top plan view of the planer of FIG. 12 planing a surface having an interfering structure on the right side.
Figure 15:
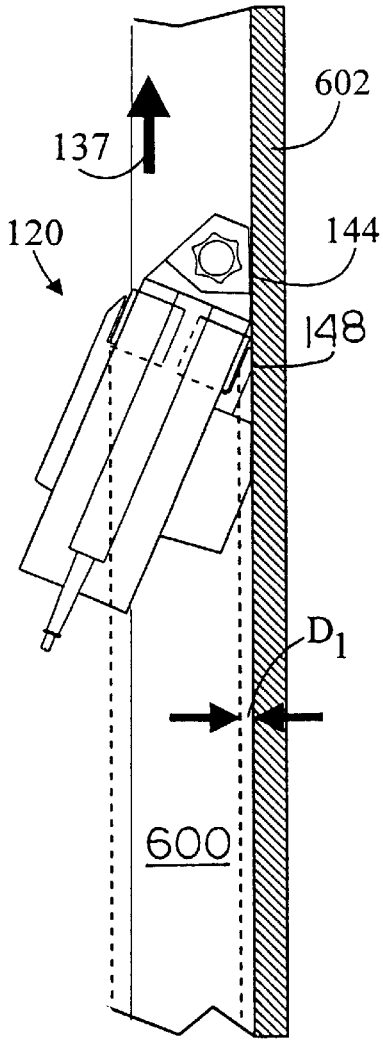

FIG. 14 is a reduced top plan elevation view of the third embodiment planer 120 planing a surface 604 adjacent a left interfering structure 606, and FIG. 15 is a reduced top plan view of the third embodiment planer 120 planing a surface 600 adjacent right interfering structure 602. The advantage of planer 120 is that it may plane close to two opposite interfering structures 602 and 606 while only being moved in an upward direction 137. This is accomplished by abutting left edges 194 and 198 against the left interfering structure 606 in FIG. 14 and abutting right edges 144 and 148 against the right interfering structure 602 in FIG. 15.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. A planer, comprising:

a front shoe;

a housing having:

a rear shoe;

a cylindrical rotatable cutter assembly disposed between said front shoe and said rear shoe; and, an edge;

a longitudinal axis passing through said front shoe, said cutter assembly, and said rear shoe;

said cutter assembly having an axis of rotation perpendicular to said longitudinal axis;

when rotated said cutter assembly defining a cutting line parallel to said axis of rotation;

when rotated said cutter assembly having a forward most projecting line parallel to said axis of rotation, said forward most projecting line having an end;

said edge of said housing defined by an angled line, said angled line making an acute angle with said longitudinal axis; and, said end of said forward most projecting line disposed proximate to said angled line.

2. The planer according to claim 1, further including:

a bearing at the outer end of the cylindrical cutter having a front outermost point; and, said angled line substantially defined by a line from said front outermost point of said bearing to said end of said forward most projecting line of said cutter assembly.

3. The planer according to claim 2, further including said front shoe having another edge substantially defined by said angled line.

4. The planer according to claim 3, wherein said housing and front shoe are constructed to have said angled line on the right side of said planer forming an acute angle A with respect to said longitudinal axis.

5. A planer according to claim 3, wherein said housing and front shoe are constructed to have said angled line on the left side of said planer forming an acute angle B with respect to said longitudinal axis.

6. A planer according to claim 3, further including said housing and front shoe constructed to have said angle lines on both the right and left side of said planer with said line on said right side forming an acute angle A with respect to said longitudinal axis and said line of said left side forming an acute angle B with respect to said longitudinal axis, and said second, acute angle B being on an opposite side of said longitudinal axis from said acute angle A.

7. A method for planing an inside corner; comprising: providing an electric power planer having a housing, a cylindrical cutter having a cutter envelope, and a bearing, the housing having an edge substantially defined by a line from the end of the forward most projecting line of the cylindrical cutter envelope to the front outmost point of the bearing;

providing a workpiece adjacent an interfering structure; and planing said workpiece while touching said interfering structure with said edge of said housing.

8. The method for planing an inside corner according to claim 7, said step of providing said electric power planer further including providing a front shoe having an edge substantially defined by said angled line and said step of planing said workpiece further including touching said interfering structure with said edge of said front shoe.

9. The method for planing an inside corner according to claim 8, further including providing at least one wedge and prior to said step of planing said workpiece, inserting said at least one wedge between said workpiece and said interfering structure.

10. The method for planing an inside corner according to claim 8, further including after said step of planing said workpiece, removing said at least one wedge from between said workpiece and said interfering structure.

* * * * *